United States Patent [19]

Masaki et al.

[11] 4,138,844

[45] Feb. 13, 1979

[54] SYSTEM FOR REDUCING POLLUTANTS IN ENGINE EXHAUST GAS

[75] Inventors: Kenji Masaki; Suzuo Suzuki, both of Yokohama; Mitinobu Konno, Yokosuka, all of Japan

[73] Assignee: Nissan Motor Company, Limited, Yokohama, Japan

[21] Appl. No.: 496,894

[22] Filed: Aug. 12, 1974

[30] Foreign Application Priority Data

Aug. 17, 1973 [JP] Japan ..... 48/92290

[51] Int. Cl.[2] ..... F01N 3/10; F01N 3/12

[52] U.S. Cl. ..... 60/286; 60/290; 60/294

[58] Field of Search ..... 60/286, 289, 290, 294, 60/282

[56] References Cited

U.S. PATENT DOCUMENTS

| | | | |
|---|---|---|---|
| 3,059,421 | 10/1962 | Schnabel | 60/294 |
| 3,704,592 | 12/1972 | Panhard | 60/294 |
| 3,708,980 | 1/1973 | Truxell | 60/301 |
| 3,768,259 | 10/1973 | Carnahan | 60/285 |
| 3,779,014 | 12/1973 | Nohira | 60/286 |
| 3,785,153 | 1/1974 | Schwing | 60/282 |
| 3,788,070 | 1/1974 | Camarasa | 60/290 |
| 3,827,237 | 8/1974 | Linder | 60/289 |
| 3,839,862 | 10/1974 | Gota | 60/282 |

*Primary Examiner*—Douglas Hart

[57] ABSTRACT

An engine having an even number of cylinders is caused to produce two differently composed exhaust gases, one rich in air and the other in unburned fuel and CO, from the two groups of cylinders each consisting of half the number of cylinders being fired in succession, which exhaust gases are fed separately to a thermal reactor and allowed to gradually mix with each other for mild and slow reaction therein.

6 Claims, 3 Drawing Figures

SYSTEM FOR REDUCING POLLUTANTS IN ENGINE EXHAUST GAS

The present invention relates to a system for reducing concentrations of harmful substances in multi-cylinder internal combustion engine exhaust gases, in which system two differently composed exhaust gases, one rich in unburned fuel and the other in air, are produced and slowly burned in a thermal reactor.

Concentrations of harmful substances in an internal combustion engine exhaust gas are greatly dependent on the air to fuel ratio (A/F) of the combustible mixture fed to the engine. When an A/F near the stoichiometric ratio is employed, the highest concentrations of nitrogen oxides (NOx) are produced, unburned hydrocarbons (HC) and carbon monoxide (CO) although not maximum are also contained in considerably high concentrations. A lower A/F, which means a rich mixture, causes increase in concentrations of HC and CO. A higher A/F or a lean mixture causes concentrations of these two substances to decrease, particularly CO, while NOx concentration can be decreased by employment of either a considerably high or low A/F.

It is, however, very hard to reduce concentrations of HC and CO in the exhaust gas to values low enough to meet current requirements solely by employment of an A/F deviated from the stoichiometric ratio. Accordingly, a thermal reactor or after-burner is frequently used to convert the discharged HC and CO into harmless oxides even when a considerably high or low A/F is employed. Thus, it may seem quite favorable to use a lean mixture considering the above facts, but CO shows extremely poor reactivity with air in low concentration and/or at relatively low temperatures. In reality a rich mixture is more favorable because the resulting large amounts of HC and CO can easily be oxidized in a suitable thermal reactor while NOx concentrations are inherently decreased as mentioned above. For practical application, however, a rich mixture is quite unfavorable from the viewpoint of fuel economy.

It is therefore a major object of the present invention to provide a system for effectively reducing concentrations of harmful substances in an exhaust gas from a typical internal combustion engine having an even number of combustion chambers accompanied with substantially no increase in fuel consumption.

It is another object of the invention to provide such a system which maintains this function even when the engine is operated at low load and the exhaust gas temperature decreases.

In brief, a system of the invention for an internal combustion engine having an even number of combustion chamber comprises two exhaust manifolds, a thermal reactor and means to cause the first exhaust manifold to discharge a first exhaust gas containing relatively large amounts of unburned fuel and carbon monoxide and a relatively small amount of air and to cause the second exhaust manifold to discharge a second exhaust gas containing relatively small amounts of unburned fuel and carbon monoxide and relatively large amount of air. The first and second exhaust manifolds are communicable with first and second groups of combustion chambers each consisting of half of the total combustion chambers, and combustion chambers of each group are fired in succession. The thermal reactor comprises a body forming a reaction chamber therein, two inlets to the reaction chamber communicating with the outlets of the first and second exhaust manifolds, respectively, and a discharge port communicating with the reaction chamber and is arranged such that the first and second exhaust gases are mixed gradually with each other in the reaction chamber and the unburned fuel and carbon monoxide react or burn relatively slowly with the air to give harmless oxides prior to discharge from the reaction chamber.

The system may further comprise means to supply auxiliary air to the first exhaust gas when the engine load is below a predetermined value to cause a portion of unburned fuel in the first exhaust gas to burn in the first exhaust manifold thereby to prevent an excessive reduction of the gas temperature.

The invention will become more clear from the following detailed description of preferred embodiments thereof taken with the accompanying drawings, in which.

Figure 1:
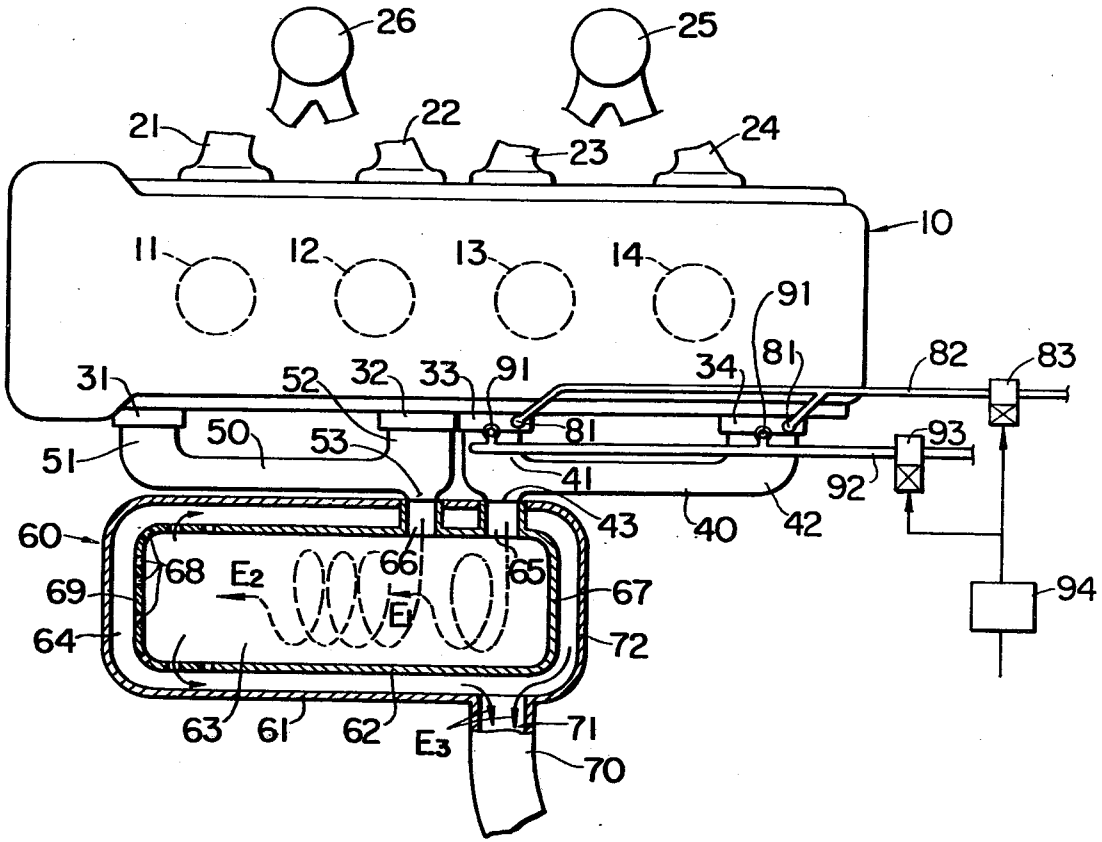
FIG. 1 is a schematic plan view, partially in section, of a four-cylinder engine provided with a first preferred embodiment of a system of the invention.

Referring to FIG. 1, a four-cylinder internal combustion engine 10 has four engine cylinders or combustion chambers designated 11, 12, 13 and 14, which are, respectively, provided with inlet ports 21, 22, 23 and 24 and exhaust ports 31, 32, 33 and 34. The firing order of the four engine cylinders 11–14 is 11-13-14-12. A first exhaust manifold 40 having two branches 41 and 42 and an outlet 43 is connected to the exhaust ports 33 and 34, and a second exhaust manifold 50 independent from the first manifold 40 and having two branches 51 and 52 and an outlet 53 is connected to the exhaust ports 31 and 32. A thermal reactor 60 is made up of an outer cylindrical body 61 and an inner cylindrical body 62 forming a reaction chamber 63 within the inner body 62 and a space 64 between the two bodies 61 and 62. The inner body 62 is provided with two inlets 65 and 66 at a region near a bottom end 67 thereof, which are connected, respectively, to the outlets 43 and 53 of the exhaust manifolds 40 and 50 across the space 64 and through the wall of the outer body 61.

The inlets 65 and 66 are isolated from the space 64 as illustrated in FIG. 1. A plurality of holes 68 are formed through the wall of the inner body 62 at a region near a top end 69 thereof to allow the reaction chamber 63 to communicate with the surrounding space 64, which in turn communicates with an exhaust pipe 70 through a discharge port 71 formed through the outer body 61 at a location close to a bottom end 72 thereof.

According to the invention, the four combustion chambers 11–14 are divided into a first group consisting of the cylinders 13 and 14 and a second group of the cylinders 11 and 12. It should be understood that an even number of combustion chambers of an engine are divided into two groups consisting of half the number of the total combustion chambers, respectively, and that the firing order of the engine is arranged such that all the cylinders of one group are fired in succession.

It is an important feature of the invention to cause a first exhaust gas from the first group of cylinders 13 and 14 and a second exhaust gas from the second group of cylinders 11 and 12 to differ with each other in their compositions. The first exhaust gas is required to contain relatively large amounts of CO and unburned fuel or HC, and the second exhaust gas to contain air in large excess and relatively small amounts of CO and unburned fuel.

A method of producing such two types of exhaust gases is to supply a rich air-fuel mixture and a lean mixture to the first and second groups of cylinders, respectively, by means of either two sets of carburetting systems 25 and 26 or a controllable fuel injection system (not shown). Alternatively, it is accomplished by allowing both the first and second groups of cylinders 11–14 to produce the second exhaust gas employing only the lean mixture and by enriching the exhaust gas from the first group 13 and 14 with unburned fuel within the exhaust manifold 40. In such a case, the first exhaust manifold 40 is equipped with fuel injectors 81, at locations close to the exhaust ports 33 and 34, and the injectors 81 communicate with a fuel system (not shown) through a fuel duct 82 under the control of a valve 83.

In operation, the first exhaust gas containing large amounts of unburned substances enters the reaction chamber 63 through the inlet 65 and flows towards the top end 69 of the inner body 62 as shown by the arrow $E_1$ in FIG. 1. Following a discharge from the cylinder 14, the second group of cylinders 11 and 12 are fired and discharge the second exhaust gas containing abundant air. The second exhaust gas flows into the reaction chamber 63 through the inlet 66 and follows the first exhaust gas $E_1$ as shown by the arrow $E_2$. The first and second exhaust gases are thereafter fed to the reaction chamber 63 one after the other, so that a generally stratified stream of the exhaust gases is established in the reaction chamber 63. A stratum can overtake the preceding one flowing ahead of it due to retardation of the latter by the resistance of the top end wall 69 of the reaction chamber 63. Contact between the first and second exhaust gases not only allows the two gases to mix gradually with each other, but also causes burning reactions to occur at the contact area because the second exhaust gas produced by an oxygen-rich combustion still remains at a considerably high temperature. The thus initiated burning reactions proceed mildly and in a manner comparable with stratified burning, causing the unburned HC and CO in the exhaust gases to be oxidized almost completely within the reaction chamber 63.

After mixing and reaction, the exhaust gases enter the space 64 through the holes 68 and flow towards the outlet 71 of the reactor 60 as shown by the arrow $E_3$ in FIG. 1. The inner body 62 is heated by the burned exhaust gases flowing around it. The exhaust gases are finally discharged through the exhaust pipe 70.

It is an important feature of the invention that two types of exhaust gases rich in air and in oxidizable substances, respectively, are fed to the thermal reactor 60 one after the other in a relatively large quantity resulting from successive firing of the two cylinders 11 and 12 of one group followed by 13 and 14 of the other group. As a result, oxidation reactions in the reactor 60 proceed mildly or slowly taking a sufficiently long time to accomplish almost complete conversion of HC and CO into harmless oxides. Besides, the reactions occur not locally at specific areas of the reactor 60, e.g., near the inlets 65 and 66, but uniformly throughout the reaction chamber 63. Accordingly the entire surface of the inner body 62 is uniformly heated, causing the life of the reactor 60 to be prolonged.

The first exhaust manifold 40 is preferably provided with air nozzles 91 at locations close to the exhaust ports 33 and 34. An air duct 92 for these nozzles 91 is governed by a solenoid valve 93, which is normally closed and is activated by power supplied from a control unit 94 comprising means to sense the engine load and a switch. When the load on the engine 10 falls below a value and the first exhaust gas temperature becomes too low to achieve the expected reactions in the thermal reactor 60, the control unit 94 operates the valve 93 and feeds secondary or auxiliary air into the first exhaust gas through the air duct 92 and nozzles 91. As a result, a portion of the unburned fuel in the first exhaust gas is burned within the exhaust manifold 40, allowing the exhaust gas temperature to increase sufficiently prior to feeding of the exhaust gases into the reactor 60.

To promote such an after-burning in the exhaust manifold 40 during a low-load operation of the engine 10, the first exhaust gas is preferably further enriched with fuel. The enrichment may be accomplished by controlling the A/F of the combustible mixture to be fed to the first group of cylinders 13 and 14. When the above described fuel injectors 81 are employed, such fuel enrichment can be accomplished simply by regulating the fuel supply rate from the fuel injectors 81. For example, a solenoid valve 83 is provided in the fuel duct 82 and is controlled by the control unit 94. The valve 83 is normally kept open, and is further openable by the operation of the control unit 94 in response to the engine load reduction.

In the engine 10 of FIG. 1, it will be apparent that the firing order of the four cylinders 11–14 may be 11-12-14-13 instead of the afore-mentioned 11-13-14-12 and that the apportionment of the rich and lean mixtures to the first and second groups of cylinders 11–14 may be the reverse of the above description.

Figure 2:
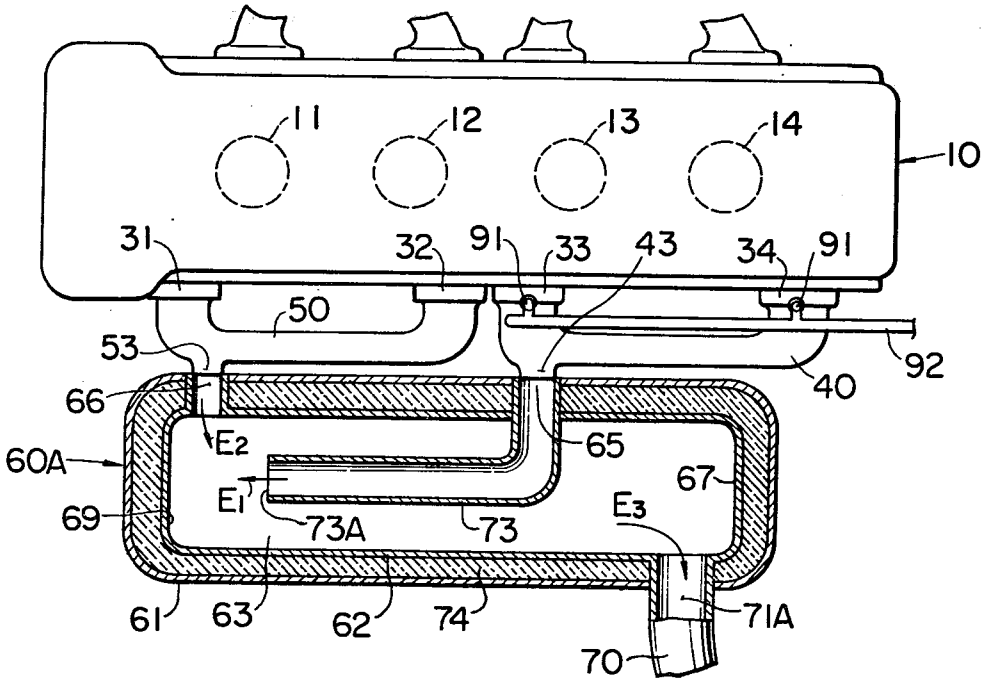
FIGS. 2 and 3 are similar views showing second and third preferred embodiments of the invention, respectively.

A second embodiment of the invention shown in FIG. 2 employs a thermal reactor 60A, which is modified from the reactor 60 of FIG. 1. A curved tube 73 is connected to the inlet 65 communicating with the first exhaust manifold 40 in such an arrangement that the opening 73A thereof is located preferably around the longitudinal axis of the inner body 62 and close to the other inlet 66, which is located close to the top end 69. The reaction chamber 63 directly communicates with the exhaust pipe 70 through a discharge port 71A formed through the wall of the inner body 62 at a location close to the bottom end 67. The space 64 of FIG. 1 between the inner and outer bodies 61 and 62 is filled with a heat insulator 74. In this reactor 60A, the two types of exhaust gases $E_1$ and $E_2$ supplied through the opening 73A and the inlet 66, respectively, can mix and react with each other in a substantially similar manner as in the reactor 60 of FIG. 1 during their flow towards the bottom end 67. The first exhaust gas containing abundant unburned fuel is preheated during it passage passing through the tube 73 by the reaction heat produced in the reaction chamber 63. Thus, the thermal reactor 60A features thorough burning therein due to preheating of the fuel-rich exhaust gas and maintenance of high temperatures by the heat insulator 74.

Figure 3:
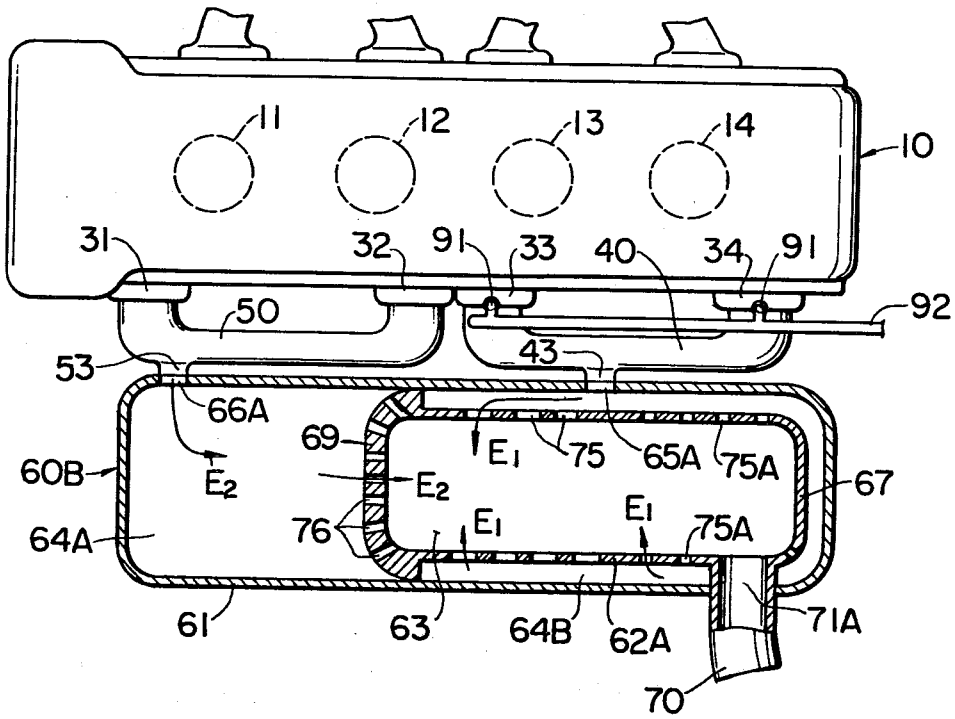

In a third embodiment of the invention shown in FIG. 3, a thermal reactor 60C is assembled to divide the space 64 between the outer body 61 and a modified inner body 62A into an end region 64A communicating with the second exhaust manifold 50 and the remainder region 64B surrounding the major portion of the inner body 62A and communicating with the first exhaust manifold 40 through an inlet 65A formed through the wall of the outer body 61. A multiplicity of holes 75 are formed through the peripheral wall of the inner body 62A exposed to the annular space 64B, and a plurality of holes 76 are formed through the top end 69 exposed to the end space 64A. The opening area of the peripheral holes 75 is preferably varied so that holes 75A remoter from the top end 69 and near the discharge port 71A may have a smaller area than holes 75 closer to the top end 69. The first exhaust gas $E_1$ and the second exhaust gas $E_2$ flow into the reaction chamber 63 through the peripheral holes 75, 75A and through the top end holes 76, respectively. Due to the difference in the opening area of the holes 75 and 75A, a major portion of the first exhaust gas enters the annular space 64B and flows into the reaction chamber 63 at regions near the top end 69. Accordingly, burning reactions in the reaction chamber 63 are initiated at such regions, and the mixed exhaust gases $E_1$ and $E_2$ flow towards the discharge port 71A continuing the burning. The minor portion of the first exhaust gas $E_1$ entering the reaction chamber 63 through the smaller holes 75A is mixed with a large amount of high temperature gas and is readily burned. Since the major portion of the inner body 62A is surrounded by the first exhaust gas which has a relatively low temperature, the inner body 62A is prevented from becoming excessively hot.

It will be apparent that the air nozzles 81 for introduction of the auxiliary air to compensate the temperature decrease during a low-load engine operation and/or the fuel injectors 91 for enrichment of the first exhaust gas may also be employed in combination with either the thermal reactor 60A of FIG. 2 or 60B of FIG. 3.

A system of the invention is most suitable for use with a four-cylinder engine 10 as illustrated above, but is also applicable to other types of engines such as V-8 or X-16 engine.

What is claimed is:

1. A system for reducing concentrations of harmful substances in an exhaust gas from an internal combustion engine before emission into the atmosphere, the engine having at least four and an even number of combustion chambers, the system comprising:

a first exhaust manifold communicable with a first group of combustion chambers consisting of one half of said combustion chambers being fired in succession, and having an outlet;

a second exhaust manifold communicable with a second group of combustion chambers consisting of the other half of said combustion chambers also being fired in succession, and having an outlet, said first group of combustion chambers being fired in succession before said second group of combustion chambers is fired in succession and this order of firing continuing through the successive firing of the combustion chambers in the engine;

first means to cause said first exhaust manifold to discharge a first exhaust gas containing relatively large amounts of unburned fuel and carbon monoxide and to cause said second exhaust manifold to discharge a second exhaust gas containing relatively small amounts of unburned fuel and carbon monoxide and a relatively large amount of air; and a thermal reactor having a body forming therein a generally cylindrical reaction chamber having two inlets and an exit, said two inlets being connected with said outlet of said first exhaust manifold and said outlet of said second manifold, respectively, and being located relatively close to one end wall of said reaction chamber, said exit being located in another end wall of said reaction chamber relatively remote from said one end wall and arranged such that an exhaust gas supplied to said reaction chamber through either of said two inlets is discharged through said exit after being retarded in its movement by the resistance of said another end wall of said reaction chamber; whereby a stream of one or said first and second gases in said reaction chamber is retarded so that a stream of the other exhaust gas subsequently fed to said reaction chamber overtakes and gradually mingles with the former stream before the respective streams are discharged completely from said reaction chamber, in which said exit of said reaction chamber takes the form of a plurality of holes formed through a portion of the body of said reaction chamber including said other end wall, further comprising second means to supply auxiliary air to said first exhaust gas when the engine load is below a predetermined value to burn a portion of said unburned fuel within said first exhaust manifold and thereby to prevent an excessive reduction of said first exhaust gas temperature.

2. A system as claimed in claim 1, in which said second means comprise at least one air nozzle provided in said first exhaust manifold, an air duct connected to said nozzle, a normally closed valve disposed in said air duct and third means to cause said valve to open when the engine load is below said predetermined value.

3. A system as claimed in claim 1, in which said first means comprise at least one fuel injector provided in said first exhaust manifold and other means to supply auxiliary fuel to said first exhaust manifold through said fuel injector, said first and second groups of combustion chambers being fed with an air-fuel mixture of an air/fuel ratio above a stoichiometric ratio.

4. A system as claimed in claim 3, in which said other means comprise a fuel duct connected to said fuel injector, a valve normally open partially and disposed in said fuel duct, the valve opening being variable, and still other means to cause said opening to enlarge when the engine load is below a predetermined value.

5. A system as claimed in claim 1, in which said thermal reactor comprises a cylindrical outer body and a cylindrical inner body arranged coaxially with said outer body, said inner body forming said reaction chamber therein, said outer body defining therein a space surrounding said inner body and having an outlet located relatively close to said one end wall of said reaction chamber, said space communicating with said reaction chamber exclusively through said exit of said reaction chamber.

6. A system for reducing concentrations of harmful substances in an exhaust gas from an internal combustion engine before emission into the atomsphere, the engine having at least four and and an even number of combustion chambers, the system comprising:

a first exhaust manifold communicable with a first group of combustion chambers consisting of one half of said combustion chambers being fired in succession, and having an outlet;

a second exhaust manifold communicable with a second group of combustion chambers consisting of the other half of said combustion chambers also being fired in succession, and having an outlet, said first group of combustion chambers being fired in succession before said second group of combustion chambers is fired in succession and this order of firing continuing through the successive firing of the combustion chambers in the engine;

first means to cause said first exhaust manifold to discharge a first exhaust gas containing relatively large amounts of unburned fuel and carbon monoxide and to cause said second exhaust manifold to discharge a second exhaust gas containing relatively small amounts of unburned fuel and carbon monoxide and a relatively large amount of air; and a thermal reactor having a body forming therein a generally cylindrical reaction chamber having two inlets and an exit, said two inlets being connected with said outlet of said first exhaust manifold and said outlet of said second manifold, respectively, and being located relatively close to one end wall of said reaction chamber, said exit being located in another end wall of said reaction chamber relatively remote from said one end wall and arranged such that an exhaust gas supplied to said reaction chamber through either of said two inlets is discharged through said exit after being retarded in its movement by the resistance of said another end wall of said reaction chamber; whereby a stream of one of said first and second exhaust gases in said reaction chamber is retarded so that a stream of the other exhaust gas subsequently fed to said reaction chamber overtakes and gradually mingles with the former stream before the respective streams are discharged completely from said reaction chambers; in which said exit of said reaction chamber takes the form of a plurality of holes formed through a portion of the body of said reaction chamber including said other end wall; and in which said first means comprise at least one fuel injector provided in said first exhaust manifold and other means to supply auxiliary fuel to said first exhaust manifold through said fuel injector, said first and second groups of combustion chambers being fed with an air-fuel mixture of an air/fuel ratio above a stoichiometric ratio.

* * * * *